United States Patent [19]

Stockman

[11] 4,063,587

[45] Dec. 20, 1977

[54] ROTOR CONSTRUCTION

[75] Inventor: Richard Franklin Stockman, Friendship, N.Y.

[73] Assignee: The Air Preheater Company, Inc., Wellsville, N.Y.

[21] Appl. No.: 803,714

[22] Filed: June 6, 1977

[51] Int. Cl.[2] ..... F28D 19/00

[52] U.S. Cl. ..... 165/8; 165/10

[58] Field of Search ..... 165/8, 9, 10

[56] References Cited

U.S. PATENT DOCUMENTS 2,946,573 7/1960 Lindhagen et al. ..... 165/10

FOREIGN PATENT DOCUMENTS 682,278 11/1952 United Kingdom ..... 165/10

*Primary Examiner*—Albert W. Davis, Jr.

*Attorney, Agent, or Firm*—Wayne H. Lang

[57] ABSTRACT

A rotor construction for a rotary regenerative heat exchanger in which sector-shaped compartments are formed between imperforate diaphragms that extend radially outward from a central rotor post. The diaphragms serve to form the sector-shaped compartments that are packed with heat absorbent plates, while they simultaneously serve as imperforate barriers which preclude fluid flow laterally between compartments as the rotor is being moved alternately between a heating fluid and a fluid to be heated. In order to simplify construction of the rotor and to improve the operating efficiency thereof, the heat absorbent element plates are arranged in a radial pattern whereby they serve as radial sealing members while they simultaneously serve as heat absorbent element.

5 Claims, 3 Drawing Figures

ROTOR CONSTRUCTION

BACKGROUND OF THE INVENTION

The present invention relates to a rotary regenerative heat exchanger including a rotor having a series of sector-shaped compartments of heat absorbent material that extends radially outward from a central rotor post. The rotor is rotated about its axis to simultaneously subject it to a flow of hot and cool fluid whereby the rotor may absorb heat from the hot fluid and transfer it to the cooler fluid flowing therethrough. More specifically, the invention relates to an arrangement by which the rotor construction of a regenerative heat exchanger is greatly simplified while the operational characteristics are greatly enhanced to produce a much improved heat exchanger at lower cost.

SUMMARY OF THE INVENTION

This invention therefore provides for a specific arrangement by which a rotor for a regenerative air preheater is greatly simplified while simultaneously the performance thereof is enhanced to provide improved resistance to the lateral flow of fluid between adjacent compartments. This arrangement is effected by reducing the number of radial diaphragms required for rotor support and replacing said structure with imperforate sheets that are arranged radially to preclude the lateral flow of fluid.

BRIEF DESCRIPTION OF THE DRAWING

Other objectives and the particular means of operation will become more apparent from the specification and the accompanying drawing in which.

DESCRIPTION OF A PREFERRED EMBODIMENT

Figure 1:
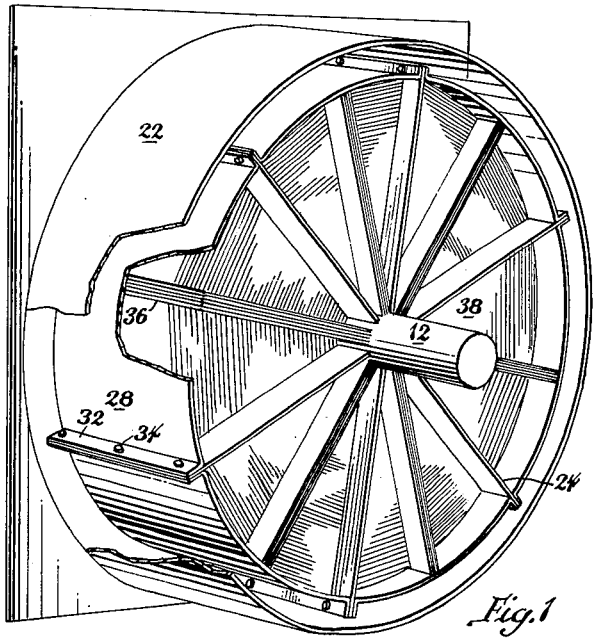
FIG. 1 is a perspective view of a rotor for a regenerative air preheater, partially broken away to show the invention.

The arrangement illustrated by FIG. 1 of the drawing shows a rotary regenerative heat exchanger having a rotor comprised of a post 12 supported on suitable bearings carried by support plates 16 that extend diametrically across an opening in end plates 18 to form spaced openings for a heating fluid and for a fluid to be heated. The end plates 18 are carried at opposite ends of an annular housing 22 that encloses the rotor containing the mass of heat absorbent material.

The rotor is formed by a series of partitions or diaphragms 24 that are axially welded at one end to the rotor post 12 and adapted to extend radially outward to form a series of sectorial compartments therebetween that hold the heat absorbent material 38 that absorbs heat from hot gases passing through duct 20 and imparts the heat to cool gases passing through duct 21. The outer wall of the rotor comprises a circular shell formed from a series of arcuate segments 28 between diaphragms and having a radial flange 32 that is secured to the ends of adjacent diaphragms by bolts 34. The rotor is then rotated about its axis by any conventional prime mover such as motor and reduction gear 35 whereby the heating fluid and the fluid to be heated are alternately directed axially through the heat absorbent material of the rotor.

The axially remote edge of each radial partition 24 or an imperforate bar affixed thereto is adapted to rub against or in closely spaced relation with the adjacent face of end plate 16 whereby upon rotation of the rotor there can be little or no lateral flow between ducts carrying a high pressure fluid to be heated and a lower pressure heating fluid.

Inasmuch as the efficiency of operation of a heat exchanger as above defined is dependent to a great extent upon the efficiency with which the heating fluid and the fluid to be heated are maintained in their own independent passageways, it would appear that the efficiency of operation of the device is directly dependent upon the number of equally spaced radial diaphragms 24 that might be welded to the central rotor post 12 and the sealing relationship that results therefrom. However, it is also known that construction costs rapidly increase with the amount of welding required during construction of the unit. Therefore, construction costs would increase as the number of radial diaphragms would be increased . However, according to this invention there is provided a rotor arrangement for rotary regenerative heat exchanger requiring minimal amounts of welding so that the costs of construction are substantially reduced while operational advantages which result from the presence of additional diaphragms are, by contrast, greatly increased.

According to this invention a minimum number of diaphragms 24 are first welded radially to a central rotor post 12. The number of diaphragms used is not critical, but it is generally understood that small rotors require fewer fixed diaphragms than do units of a larger size so that, for example, only four to six diaphragms are required for a small sized preheater. To compensate for a reduced number of welded diaphragms, the heat absorbent material of each compartment includes several juxtaposed imperforate heat absorbent sheets 36 that are arranged radially at the approximate mid-point of each sectorial compartment. The sheets 36 are adapted to extend radially outward to segments 28, a distance somewhat less than the length of each diaphragm 24, while they are adapted to extend axially into close proximity with the imperforate surface of the adjacent end plate so as to preclude fluid flow therebetween. The sectorial space at each side of the parallel sheets is filled with an arrangement of radial or transverse heat absorbent material 38 that permits the axial flow of fluid through the compartments of the rotor, whereby said material is in a position to absorb heat from the hot fluid and then give it up to the fluid to be heated.

Figure 2:
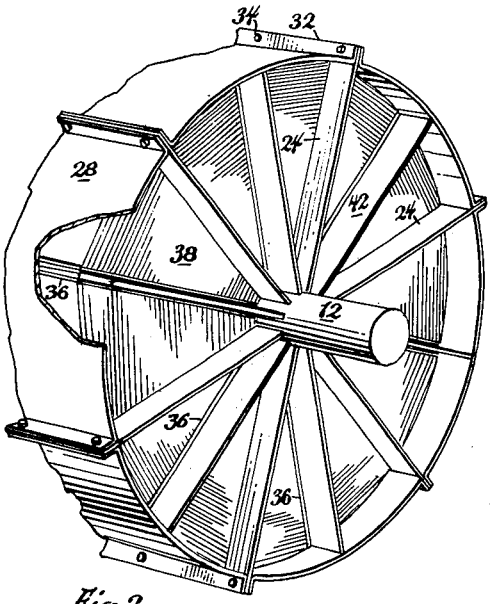
FIG. 2 is a perspective view of a rotor for a regenerative air preheator of a slightly modified form.

In a slightly modified form of the invention as shown in FIG. 2, the radial element sheets 36 do not extend axially to the plates 16 at the ends of the rotor. Instead, a radial sealing bar 42 in axial alignment with sheets 36 is welded to the rotor post and to the rotor shell in axial alignment with one or more of the sheets 32 whereby together they will form a barrier for the transverse flow of fluid.

Figure 3:
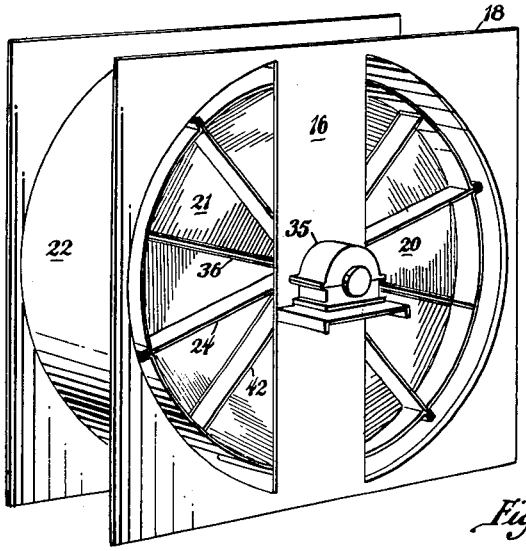
FIG. 3 is a perspective view of the rotor shown by FIG. 2 as enclosed in a simplified form of housing.

An arrangement by which a rotor of the type shown by either FIG. 1 or FIG. 2 may be enclosed in a simplified cylindrical housing is shown in FIG. 3 where leakage of one fluid to the other is precluded by maintaining at all times the edge of a diaphragm 24, radial element 36 (FIG. 1), or bar 42 (FIGS. 2 and 3) in close proximity with the inner face of center beam 16.

I claim:

1. Rotary regenerative heat exchange apparatus having a rotor post, a plurality of imperforate diaphragms connected to the rotor post and extending radially from the rotor post to provide a framework for a rotor having a series of sectorial compartments therebetween, a rotor shell joining ends of the diaphragms to enclose the rotor, housing means surrounding the rotor having end plates at opposite ends thereof with imperforte sections between spaced openings that direct a heating fluid and a fluid to be heated axially through the compartments of the rotor, means for rotating the rotor about its axis to alternately align the rotor with the heating fluid and with the fluid to be heated, and imperforate heat absorbent plates carried by each compartment of the rotor midway between diaphragms being radially disposed to axially confront the imperforate portions of the end plates in a sealing relation to preclude the flow of fluid laterally between opposite sides of the lateral plates.

2. Rotary regenerative heat exchange apparatus as defined in claim 1 including sectorial element zones adjacent opposite sides of the radially arranged element plates, and a mass of heat absorbent material carried in said zones.

3. Rotary regenerative heat exchange apparatus as defined in claim 2 wherein the heat absorbent material carried in the element zones adjacent opposite sides of the radially arranged element plates tightly confronts said plates and maintains them in a radial position.

4. Rotary regenerative heat exchange apparatus as defined in claim 3 wherein the heat absorbent material carried in the element zones comprises a series of plates that extend laterally between the radial diaphragms and the radially arranged heat absorbent plates.

5. Rotary regenerative heat exchange apparatus as defined in claim 1 including an imperforate bar coextensive with the radial element and secured at its ends to the rotor post and the rotor shell to preclude the lateral flow of fluid.

* * * * *